US007551865B2

(12) United States Patent
Tomizawa

(10) Patent No.: US 7,551,865 B2
(45) Date of Patent: Jun. 23, 2009

(54) IMAGE FORMING APPARATUS

(75) Inventor: Takeshi Tomizawa, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 230 days.

(21) Appl. No.: 11/730,807

(22) Filed: Apr. 4, 2007

(65) Prior Publication Data

US 2008/0013969 A1 Jan. 17, 2008

(30) Foreign Application Priority Data

Apr. 7, 2006 (JP) ..... 2006-106615

(51) Int. Cl.
*G03G 15/00* (2006.01)

(52) U.S. Cl. ..... 399/44; 399/98; 399/315

(58) Field of Classification Search ..... 399/44, 399/99, 101, 297, 298, 302, 315, 316, 400
See application file for complete search history.

(56) References Cited

U.S. PATENT DOCUMENTS 6,044,236 A * 3/2000 Katoh et al. ..... 399/101
6,477,340 B2 11/2002 Tomizawa et al.
6,957,033 B2 10/2005 Saito et al.

FOREIGN PATENT DOCUMENTS

| | | |
|---|---|---|
| JP | 4-126261 | 4/1992 |
| JP | 4-274263 | 9/1992 |
| JP | 11-024431 | 1/1999 |
| JP | 2000-147915 | 5/2000 |
| JP | 2003-066742 | 3/2003 |

* cited by examiner

*Primary Examiner*—David M Gray
*Assistant Examiner*—Amit Bhardwaj
(74) *Attorney, Agent, or Firm*—Fitzpatrick, Cella, Harper & Scinto

(57) ABSTRACT

An image forming apparatus includes an intermediary transfer member for primary-transferring the toner at a primary transfer position so that a second color toner image is primary-transferred from an image carrying member onto a first color toner image which has been transferred in a superposition manner; a secondary transfer member for secondary-transferring the first and second color toner images together from the intermediary transfer member onto a recording; a fixing apparatus for fixing the toner images on the recording material; a guide member for guiding the recording material to the fixing apparatus; an electrical discharging member, for electrically discharging the recording material onto which the toner images are secondary-transferred; and a voltage application apparatus for applying, to the electrical discharging member before the secondary transfer, a voltage of a polarity identical to that of the first color toner image on the intermediary transfer member at a predetermined period.

5 Claims, 8 Drawing Sheets

IMAGE FORMING APPARATUS

FIELD OF THE INVENTION AND RELATED ART

The present invention relates to an image forming apparatus in which toner images are primary-transferred two or more times from the same image carrying member onto an intermediary transfer member in a superposition manner. More specifically, the present invention relates to a control for preventing contamination of a recording material onto which the toner images are secondary-transferred from the intermediary transfer member.

An image forming apparatus of the one-drum-type, as shown in FIG. 9, wherein a rotary-type developing apparatus is provided and toner images of yellow, magenta, cyan, and black are successively formed on one photosensitive drum has been put into practical use. In this one-drum-type image forming apparatus, each of the toner images is primary-transferred from the photosensitive drum onto an intermediary transfer belt to be superposed on a previously transferred toner image (or a surface of the intermediary transfer belt) for each formation thereof on the photosensitive drum. Then, a recording material onto which the toner images on the intermediary transfer belt are secondary-transferred is conveyed to a fixing device by a conveyance portion, thus obtaining a full-color image. In the one-drum-type image forming apparatus, an exposure apparatus, the photosensitive drum, a charging device, a cleaning apparatus, and the like can be common to the respective colors, so that the one-drum-type image forming apparatus is advantageous in reducing the size of an entire apparatus compared with a so-called tandem-type image forming apparatus in which four photosensitive drums are disposed in series.

However, in the case where a full-color image is formed by the one drum-type image forming apparatus as shown in FIG. 9, the following problems arise.

For example, when four toner images are transferred onto the intermediary transfer belt in a multiple toner manner in the order of a yellow toner image, a magenta toner image, a cyan toner image, and a black toner image, the yellow toner image is initially formed on the photosensitive drum and then transferred onto the intermediary transfer belt at a primary transfer portion. The intermediary transfer belt is rotated one full turn in preparation for transfer of a subsequent magenta toner image in a state in which it carries the yellow toner image at its surface. During the rotation of the intermediary transfer belt, the intermediary transfer belt carrying the yellow toner image at its surface passes through a portion close to a secondary transfer portion, particularly close to a conveyance portion of the recording material. In this case, a part of the yellow toner can be released from the intermediary transfer belt and scattered over the conveyance portion, thus contaminating the conveyance portion. In a subsequent step, the magenta toner image formed on the photosensitive drum is transferred at the primary transfer portion onto the yellow toner image on the intermediary transfer belt in a multiple transfer (superposition) manner. Thereafter, similarly as in the case of the yellow toner image described above, the intermediary transfer belt on which,the superposed yellow and magenta toner images are carried passes through the portion close to the conveyance portion. In this case, similarly as in the above described case, the toner image on the intermediary transfer belt can be released from the intermediary transfer belt and scattered over the conveyance portion, thus contaminating the conveyance portion.

Similarly, image formation of the cyan toner and the magenta toner are also performed through similar steps. The toner images formed on the intermediary transfer belt is transferred onto the recording material fed from a recording material accommodation portion and then passes through the conveyance portion. The conveyance portion after the transfer is contaminated with the scattered toner released from the intermediary transfer belt described above, and thus, the scattered toner contaminates the recording material after the secondary transfer.

SUMMARY OF THE INVENTION

A principal object of the present invention is to alleviate contamination of a conveyance portion with scattered toner from an intermediary transfer belt in a one-drum-type image forming apparatus.

Another object of the present invention is to provide an image forming apparatus capable of alleviating the contamination.

According to an aspect of the present invention, there is provided an image forming apparatus comprising:

an image carrying member for carrying a toner image;

an intermediary transfer member for primary-transferring the toner image at a primary transfer position so that a second color toner image is primary-transferred from the image carrying member onto a first color toner image which has been transferred, in an image area at a primary transfer position, from the image carrying member onto the intermediary transfer member in the image area at the primary transfer position in a superposition manner;

a secondary transfer member for secondary-transferring the first and second color toner images together from the intermediary transfer member onto a recording material at a secondary transfer position;

a fixing means for fixing the toner images on the recording material;

a guide member for guiding the recording material from the secondary transfer position to the fixing means;

an electrical discharging member, provided between the secondary transfer position and the guide member in a movement direction of the recording material, for electrically discharging the recording material onto which the toner images are secondary-transferred; and a voltage application means for applying, to the electrical discharging member before the secondary transfer, a voltage of a polarity identical to that of the first color toner image on the intermediary transfer member in a predetermined period during a period from a time at which a front end of the image area of the intermediary transfer member carrying the first color toner image passes through the secondary transfer position to a time at which a rear end of the image area reaches the first transfer position.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Hereinbelow, a color copying machine as an embodiment of the image forming apparatus according to the present invention will be described more specifically with reference to the drawings. However, the present invention is not limited to restrictive constitutions in the embodiments described below but is also practicable by other embodiments in which a port or all of the constitutions in the embodiments is replaced with an alternative constitution so long as toner images are primary-transferred from the same image carrying member onto an intermediary transfer member in a superposition manner.

Incidentally, in each of the time charts shown in FIGS. 5 to 8, an abscissa represents a time for showing a voltage application state at the time, so that an ordinate does not correspond to a magnitude of an applied voltage. The magnitude of the applied voltage is specifically shown in Tables 1 to 3 appearing hereinafter.

First Embodiment

Figure 1:
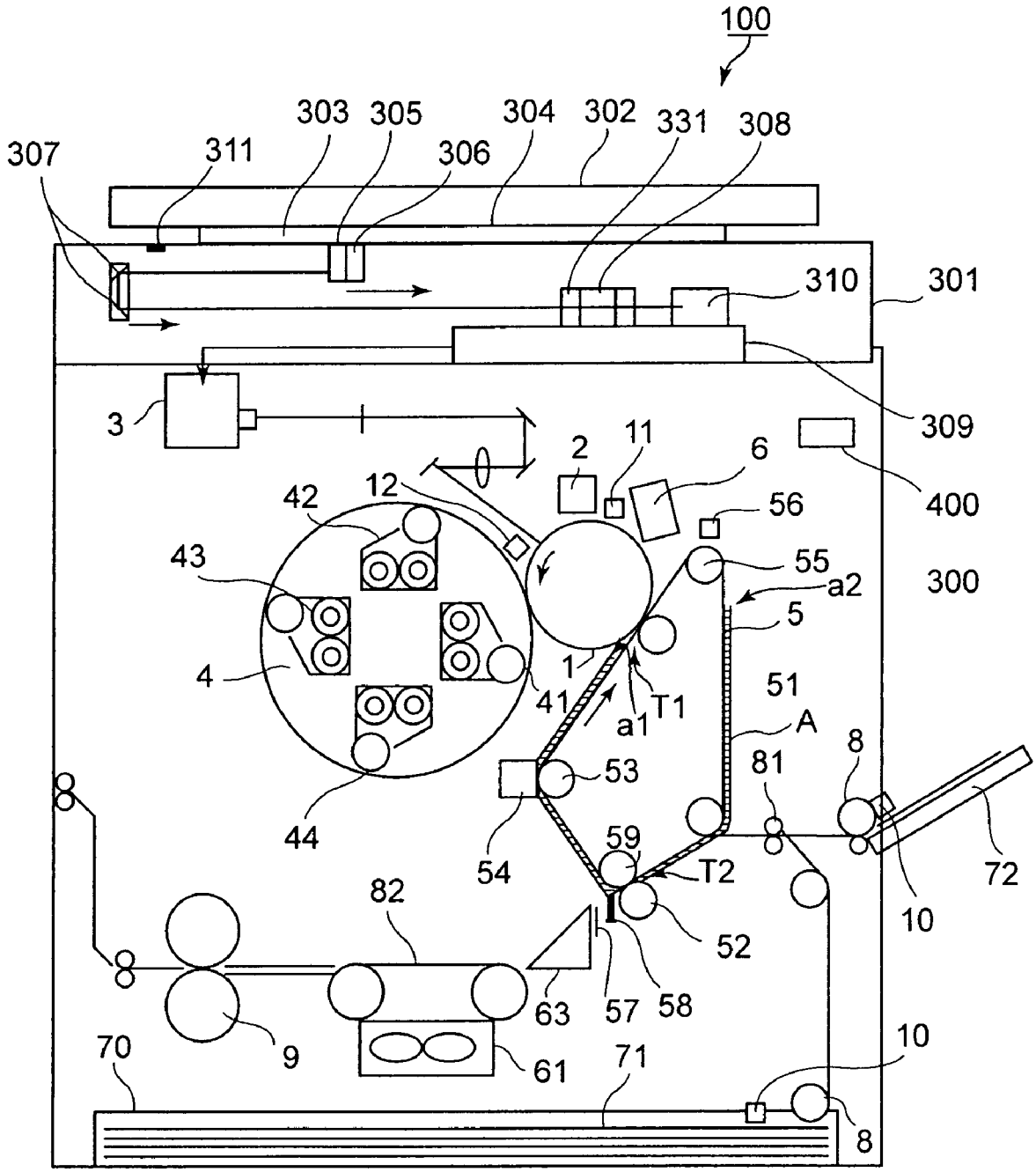
FIG. 1 is an explanatory view of a schematic constitution of an image forming apparatus according to First Embodiment.
Figure 2:
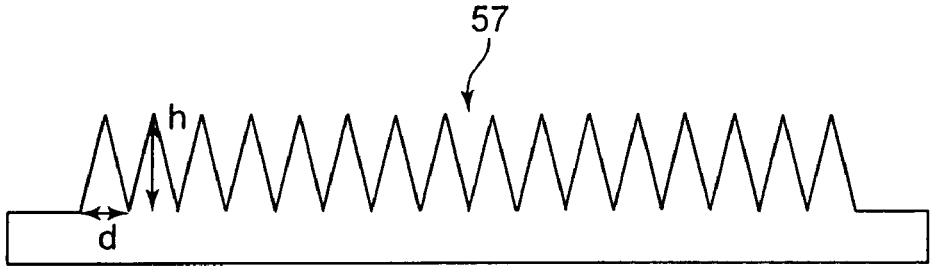
FIG. 2 is a plan view of an electrode also functioning as an electric discharging electrode.
Figure 3:
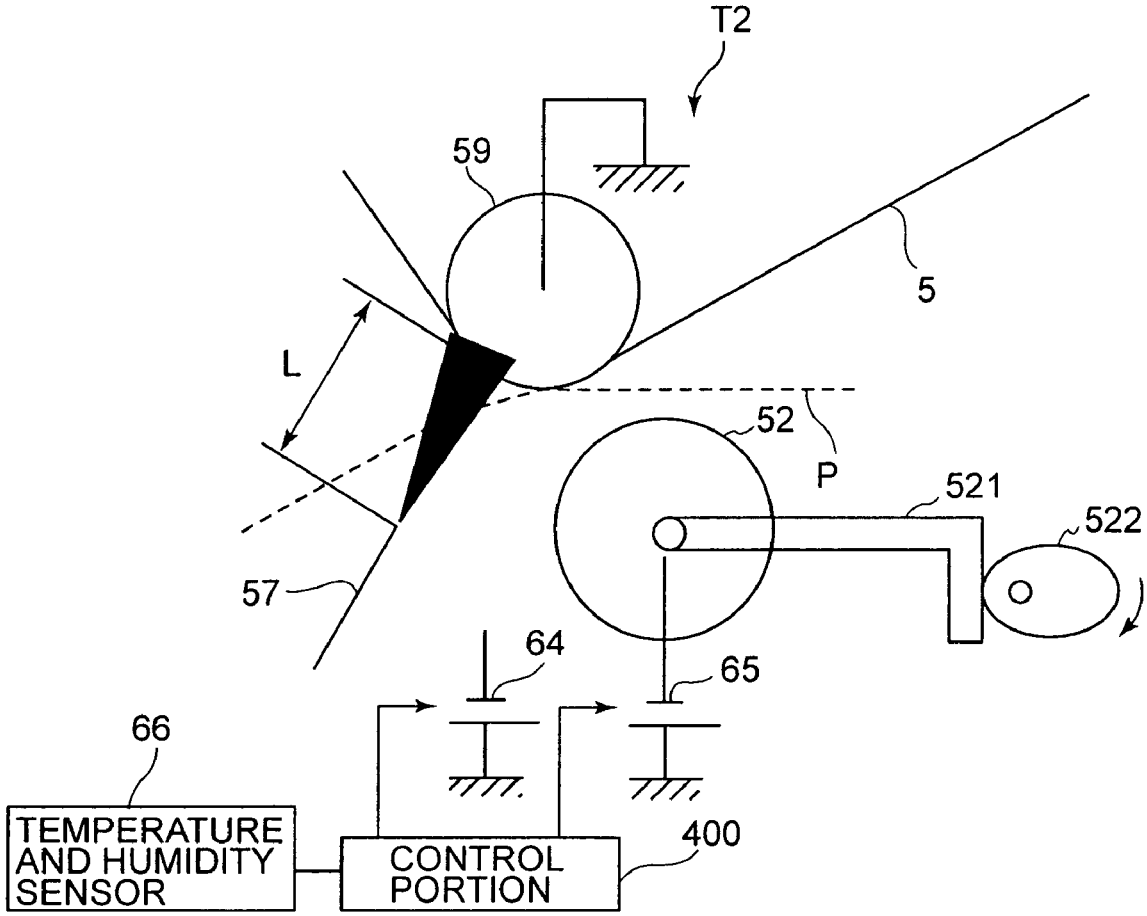
FIG. 3 is an explanatory view of a constitution of a secondary transfer portion.
Figure 4:
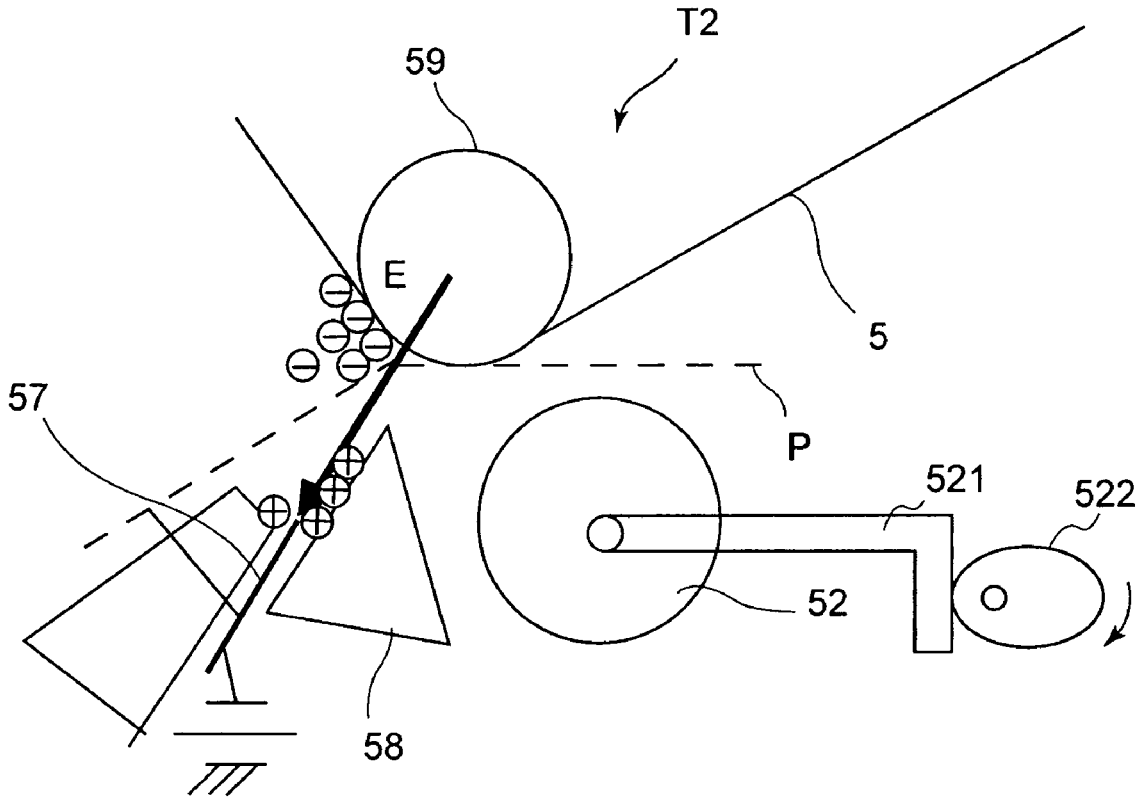
FIG. 4 is an explanatory view of a scattering prevention effect of a toner and a toner collecting effect.
Figure 5:
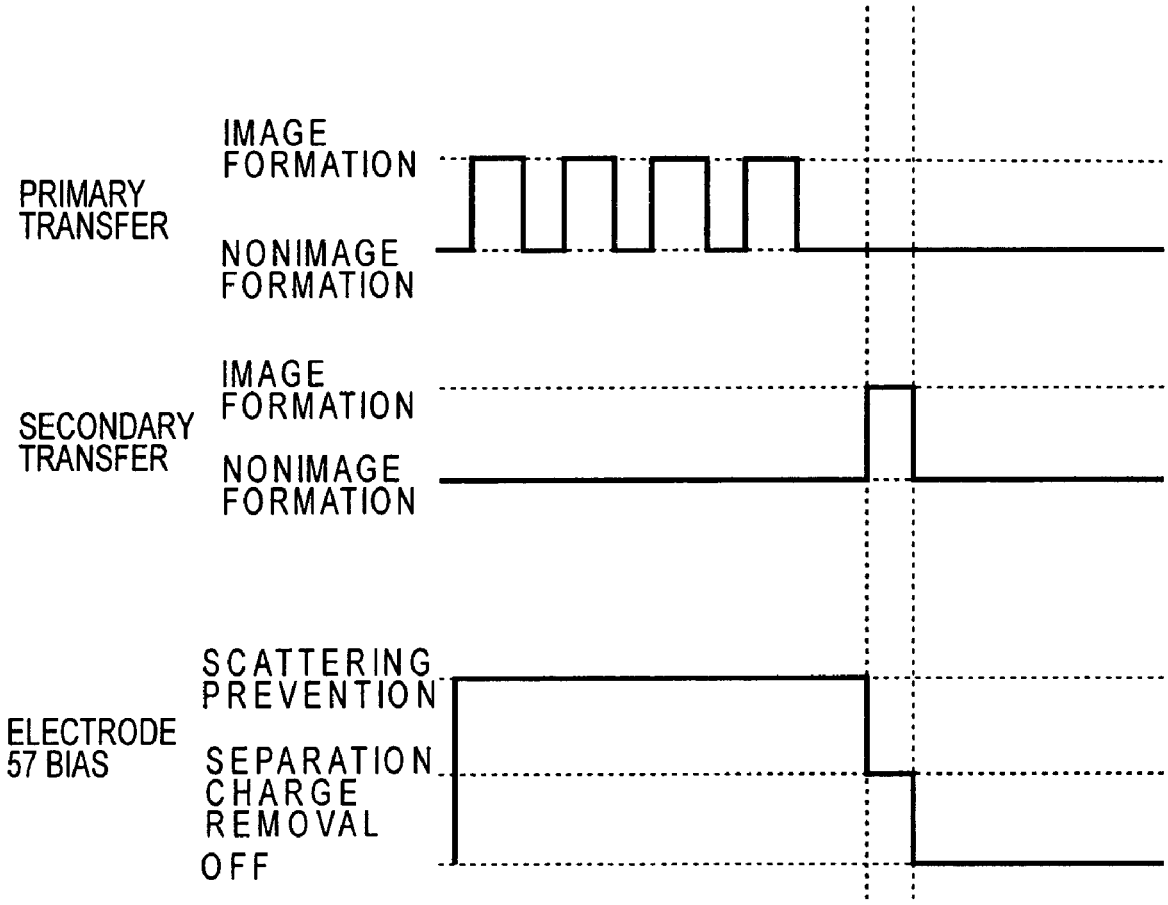
FIG. 5 is a time chart of control of bias voltage application to the electrode.
Figure 6:
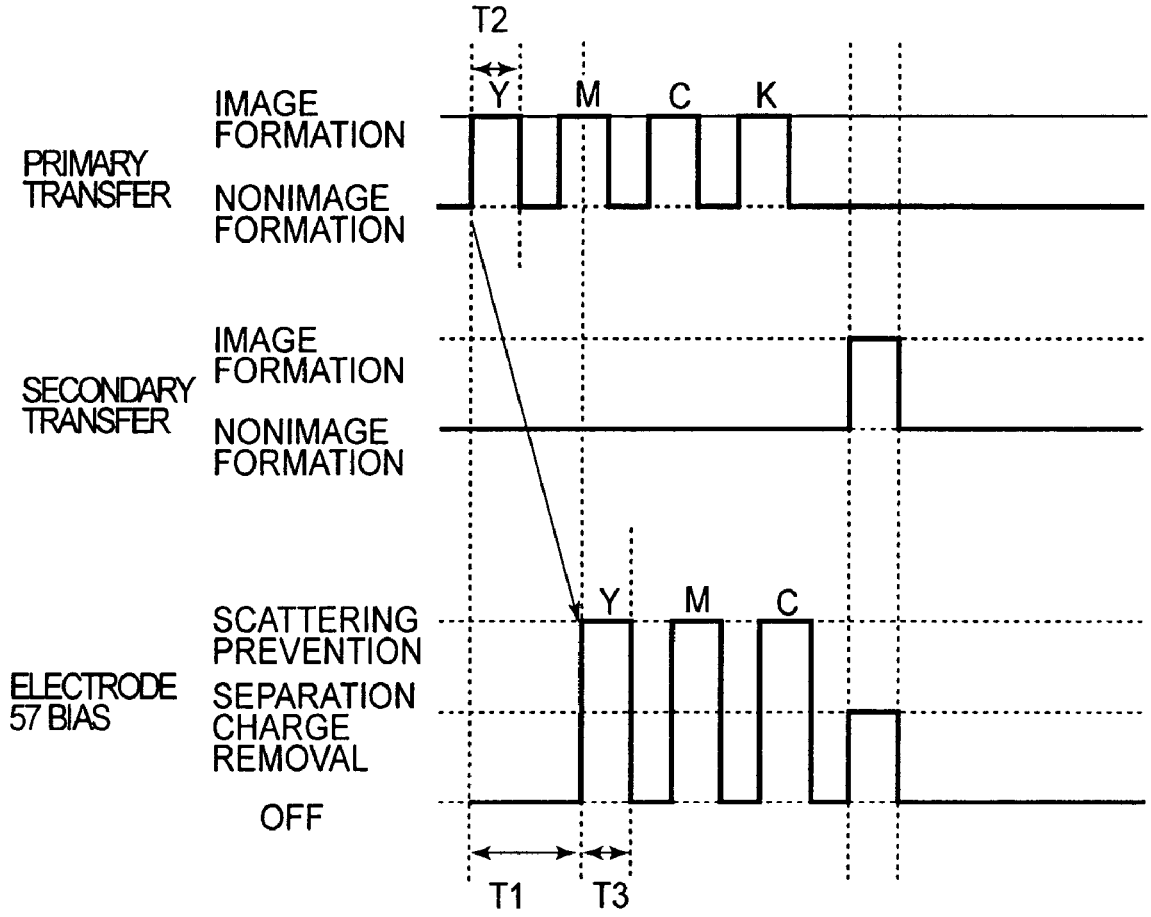
FIG. 6 is a time chart of control of discrete application of a scattering prevention voltage.

FIG. 1 is an explanatory view of a schematic constitution of an image forming apparatus in this embodiment, FIG. 2 is a plan view of an electrode also functioning as an electric discharging electrode, FIG. 3 is an explanatory view of a constitution of a secondary transfer portion, FIG. 4 is an explanatory view of a scattering prevention effect of a toner and a toner collecting effect, FIG. 5 is a time chart of the control of bias voltage application to the electrode, and FIG. 6 is a time chart of the control of discrete application of a scattering prevention voltage.

Referring to FIG. 1, in an image forming apparatus 100 according to First Embodiment, each of four primary color toner images successively formed on a photosensitive drum 1 are primary-transferred onto an intermediary transfer belt 5 in a superposition manner (for each image formation). A full-color toner image (consisting of the four color toner images) is collectively secondary-transferred onto a recording material 71. The image forming apparatus includes an upper reader portion 301 for a digital color image and a lower printer portion 300 for the digital color image.

At the reader portion 301, an original 304 is placed on an original supporting platen glass 303 and exposed to light by an exposure lamp 306 to perform scanning by an image reading portion 305. A light image reflected from the original 304 is condensed in a full-color CCD (charge-coupled device) sensor 310 by a lens 308 through a mirror 306 and the like, so that a color separation signal is generated by a processing portion 309. The color separation signal is subjected to image processing by a video processing unit in the processing portion 309 after being sent through an amplifying circuit, and then is sent toward the printer portion 300 via an image memory.

Into the printer portion 300, in addition to the signal from the reader portion 301, image signals from a computer, a facsimile apparatus, and the like are also inputted similarly. Herein, as an example, an operation of the printer portion 300 will be described on the basis of the signal from the reader portion 301.

At the printer portion 300, the photosensitive drum 1 as an image carrying (bearing) member rotates in a direction indicated by an arrow in FIG. 1 to form a toner image. Around the photosensitive drum 1, members including a pre-exposure lamp 11, a corona primary charger 2, a laser exposure apparatus 3, an electric potential sensor 12, a rotary developing device holding portion 4, a primary transfer portion T1 (primary transfer position or area), and a cleaning device 6 are disposed. At the rotary developing device holding portion 4, four developing devices 41, 42, 43 and 44 in which toners (of yellow, magenta, cyan and black) having different spectral characteristics are accommodated are disposed. The primary transfer portion T1 includes a primary transfer roller 51 to which a primary transfer bias voltage of a positive polarity is applied.

In the laser exposure apparatus 3, the image signal from the reader portion 301 is converted into a light signal at a laser output portion provided in the laser exposure apparatus 3. Scanning with the laser light converted into the light signal is performed by a polygon mirror. An outer peripheral surface of the photosensitive drum 1 is irradiated with the scanning laser light through the lens and the respective reflection mirrors.

A control portion 400 is an ordinary computer control apparatus which has a computing or processing function and is program-controlled, and totally controls the respective portions of the image forming apparatus 100 to form a full-color toner image on the recording material 71. During image formation at the printer portion 300, the control portion 400 rotates the photosensitive drum 1 in the indicated arrow direction. The outer peripheral surface of the photosensitive drum 1 after being electrically discharged by the pre-exposure lamp 11 is electrically charged uniformly by the primary charger 2. The control portion 400 effects the light exposure using the laser exposure apparatus 3 for each separation color, so that an electrostatic latent image is formed on the photosensitive drum 1 for each separation color.

Next, the control portion 400 rotates the rotary developing device holding portion 4 to move one, for an associated separation color, of the developing devices 41, 42 43 and 44 to a developing position on the photosensitive drum 1. At the developing position, the developing device 41, 42, 43 and 44 for the associated color is actuated to develop the electrostatic latent image on the photosensitive drum 1 with an associated toner, thus forming an associated separation color toner image principally comprising a resin and a pigment on the photosensitive drum 1.

Each of the toners contained in the developing devices 41, 42 43 and 44 is appropriately supplied at a desired timing from a toner accommodation portion (hopper) for the associated color disposed laterally with respect to the associated developing device. As a result, a toner ratio (or an amount of toner) in each of the developing devices 41, 42, 43 and 44 is kept at a constant level. The respective toner images for the separation colors formed on the photosensitive drum 1 are successively primary-transferred onto the intermediary transfer belt 5 in an image area A so that they are successively superposed on a previously transferred toner image on the intermediary transfer belt 5.

The intermediary transfer belt 5 is driven by a drive roller 53 and circulated in a direction of an indicated arrow. At a position opposite to the drive roller 53 through the intermediary transfer belt 5, a toner cleaning apparatus 54 is disposed contactably and separably with respect to the drive roller 53 through the intermediary transfer belt 5. Upstream from the transfer cleaning apparatus 54, a secondary transfer portion T2 for transferring the toner images from the intermediary transfer belt 5 onto the recording material 71 is disposed.

The secondary transfer portion T2 includes a secondary transfer roller 52 and a backup roller 59 which are opposed to each other via the intermediary transfer belt 5. To the outer secondary transfer roller 52, a secondary transfer bias voltage of a positive polarity is applied during the secondary transfer.

Referring to FIG. 3, by rotation of a cam 522, a supporting arm 521 for supporting the secondary transfer roller 52 is rotationally moved. During the secondary transfer, the secondary transfer roller 52 contacts the intermediary transfer belt 5 to form a secondary transfer nip.

During the superposition of the separation color toner images on the intermediary transfer belt 5, the secondary transfer roller 52 is moved apart from the intermediary transfer belt 5, so that the toner images are not rubbed by the secondary transfer roller 52. The secondary toner bias voltage is not applied to the secondard transfer roller 52.

Opposite to a follower roller 55, a detection sensor 56 is disposed. The detection sensor 56 detects a positional deviation and toner density of the toner images transferred from the photosensitive drum 1 to the intermediary transfer belt 5. On the basis of an output of the detection sensor 56, the control portion 400 corrects a primary charge potential, an image density, a toner supply amount, an image writing timing, an image writing start position, and the like factor with respect to formation of the toner images as the need arises.

The transfer cleaning apparatus 54 is pressed against the drive roller 53 after toner images required for a necessary number of colors are superposed on the intermediary transfer belt 5. The transfer cleaning apparatus 54 removes a secondary transfer residual toner remaining on the intermediary transfer belt 5 after the toner images are secondary-transferred onto the recording material 71. The surface of the intermediary transfer belt 5 after the secondary transfer is thus cleaned by the transfer cleaning apparatus 54 to be subjected again to a subsequent toner image forming step and a primary transfer step.

The recording material 71 is stored in a cassette-type accommodation portion 70 or a tray-type accommodation portion 72 and fed one by one by means of respective feeding rollers 8. The recording material 71 awaits at a predetermined position after being subjected to correction of oblique movement by registration rollers 81 and conveyed to the secondary transfer portion T2 at a timing synchronized with the toner images.

At the secondary transfer portion T2, the toner images are secondary-transferred onto the recording material 71. The recording material 71 on which the toner images are secondary-transferred is conveyed to a conveyance portion (guiding member) 82 and is then sent to a hot roller-type fixing device (fixing means) 9 by which the toner images are fixed and then is discharged in a paper (sheet) discharge tray or a post-processing apparatus.

Under the conveyance portion 82, an attraction fan 61 configured and designed for causing the recording material 71 to be attracted and firmly carried by the conveyance portion 82 so as to be stably conveyed is provided. The hot roller-type fixing device 98 has a surface layer which is not coated with a rubber but is coated with a fluorine-containing resin tube, thus being increased in operating life.

In the case where the toner images are superposed on the intermediary transfer belt 5 in the image forming apparatus 100 in the order of those of yellow, cyan, magenta and black, a yellow toner image is initially formed on the photosensitive drum 1 by a development. At the primary transfer portion T1 contacting the photosensitive drum 1, the yellow toner image is attracted by a primary transfer bias voltage of a positive polarity applied to the primary transfer roller 51 and primary-transferred onto the intermediary transfer belt 5. The intermediary transfer belt 5 is circulated one full turn in preparation for primary transfer of a subsequent magenta toner image in a state in which the yellow toner image is carried on a surface thereof.

In this case, the surface of the intermediary transfer belt 5 carrying thereon the yellow toner image passes through a portion close to the secondary transfer portion T2, particularly close to a conveyance guide (guiding member) 63. At that time, a part of the yellow toner can be released from the surface of the intermediary transfer belt 5 to scatter over the conveyance guide 63, so that there is a possibility of contamination of the conveyance guide 63 with the scattered yellow toner.

Next, the magenta toner image is formed on the photosensitive drum 1 by development and at the primary transfer portion T1, the magenta toner image is primary-transferred and superposed onto the yellow toner image carried on the intermediary transfer belt 5. Also in this case, in preparation for primary transfer of a subsequent cyan toner image, the intermediary transfer belt 5 passes through the portion close to the conveyance guide 63 in a state in which it carries thereon the yellow and magenta toner images. Further, similarly as in the above described case, a part of the toner on the surface of the intermediary transfer belt 5 can be released to scatter over the conveyance guide 63 to result in a possibility of contamination of the conveyance guide 63 with the scattered toner.

Thereafter, formation and primary transfer of the cyan toner image and the black toner image are repeated in a similar manner. The thus formed four color toner images on the intermediary transfer belt 5 are secondary-transferred onto the recording material 71 fed from the cassette-type accommodation portion 70 and pass through the conveyance guide 63. When the conveyance guide 63 has been contaminated by that time, there is a possibility that a back surface of the recording material 71 having a front surface on which the toner images are secondary-transferred is contaminated with the above described scattered toner.

Particularly, in the case of providing the attraction fan 61 for attracting the recording material 71 to the conveyance portion 82, air stream formed by the attraction fan 61 conveys and collects the toner risen up within the image forming apparatus. As a result, there is a possibility of an occurrence of serious contamination of the conveyance portion 82 with the toner.

<Toner Scattering Prevention Constitution>

The image forming apparatus 100 of this embodiment is characterized in that an electrode 57 is provided in a rising state between the secondary transfer portion (position or area) T2 and the conveyance guide 63. More specifically, during the superposition process of the separation color toner images on the intermediary transfer belt 5, a bias voltage of an identical polarity to the charge polarity of the toner images is applied to the electrode 57.

In First Embodiment, the electrode (electric discharging member) 57 having a sawtooth shape as shown in FIG. 2 is used also as an electric discharging electrode for electrically discharging the recording material 71 on which the toner images are secondary-transferred. In the step of superposing the toner images formed on the photosensitive drum 1 on the intermediary transfer belt 5 by the primary transfer, the intermediary transfer belt 5 passes through the secondary transfer portion T2 three times in a state in which the toner images (of yellow, magenta and cyan) are carried thereon. At the fourth time, the toner images are secondary-transferred onto the recording material 71, so that there is no toner image on the intermediary transfer belt 5. Thus, during the first to third passages of the intermediary transfer belt 5 through the secondary toner portion T2, the control portion 400 effects control so that a high bias voltage as a scattering prevention voltage is applied to the electrode 57. During the last (fourth) passage, a low bias voltage as an electric discharging voltage is applied to the electrode 57.

The electrode 57 is specifically formed of a 0.1 mm-thick stainless steel (SUS 304CSP) plate with a height h of 3 mm and a gap (interval) d between adjacent valleys (of tooth) of 1 mm. The material and shape of the electrode 57 are not particularly limited thereto but may also be appropriately changed. In First Embodiment, the electrode 57 also has a constitution and function as an electric discharging needle used for electric discharging for separation of the recording material 71 after the secondary transfer but the electric discharging needle may also be separately prepared in addition to the electrode 57. A specific constitution of the electrode 57 in a main assembly of the image forming apparatus is shown in FIGS. 3 and 4.

Referring to FIG. 3, the electrode 57 is located downstream from the secondary transfer portion T2 (the secondary transfer roller 52 and the backup roller 59) and upstream from the conveyance portion 82 in the conveyance direction of the recording material 71. The electrode 57 extends toward a portion close to a release (separation) portion of the backup roller 59 and the intermediary transfer belt 5. Further, a distance L from the surface of the intermediary transfer belt 5 to the electrode 57 may preferably be about 5-15 mm, more preferably about 8-12 mm. Further, an upper end of the electrode 57 is located and provided lower than a conveyance path of the recording material 71 so as not to contact the conveyed recording material 71.

Referring to FIG. 4, at an upstream portion of the electrode 57, a toner-collecting portion 58 having a surface in noncontact with the recording material 71 is provided and collects the released and scattered toner. More specifically, the toner-collecting portion 58 is provided close to the electrode 57 and is and is a resinous block to which the bias voltage is not applied. An airborne dust-like toner, rising up within the image forming apparatus, attached by the electrode 57 is collected by the surface of the resinous block. More specifically, the attracted airborne toner falls on the block surface by gravitation, thus being consequently collected by the block.

To the electrode 57, a bias voltage of a negative polarity identical to the principal charge polarity of the toner on the intermediary transfer belt 5 is applied during the passage of the toner images through the portion close to the secondary transfer portion T2 while the toner images are carried on the intermediary transfer belt 5. As a result, between the backup roller 59 of the secondary transfer portion T2 and the electrode 57, an electric field is created. This electric field has the function of suppressing scattering of toner negatively charged similarly as in the case of the toner images formed on the intermediary transfer belt 5.

Further, the positively charged toner (reversely charged toner) on the intermediary transfer belt 5 can be collected locally by the electrode 57 and the toner-collecting portion 58 located close to the electrode 57. Accordingly, an occurrence of the released and scattered toner is suppressed and a very small amount of the scattered positively charged toner is locally collected at the portion in noncontact with the recording material 71. As a result, it is possible to prevent the contamination of the conveyance guide 63 and the conveyance portion 82 with the (scattered) toner.

Incidentally, the toner-collecting surface of the toner-collecting portion 58 may also be configured to constrain the collected toner as an adhesive surface, an oil-applied surface, an uneven-structured surface, etc. It is also possible to use an electrode surface by imparting an electroconductivity the toner-collecting surface. The electrode surface may be grounded or supplied with an appropriate bias voltage.

A specific sequence is shown in FIG. 5. Referring to FIG. 5 in combination with FIG. 3, when image formation is started, the control portion 400 controls a DC electric power source (voltage application means) 64 to output a high (negative) bias voltage as a scattering prevention voltage to the electrode 57. At the substantially same time when the image formation process goes to the secondary transfer step after the fourth color toner image is formed, the control portion 400 causes the power source 64 to output a low(-negative) bias voltage as an electric discharging voltage for separating the recording material 71, after the secondary transfer, from the intermediary transfer belt.

In a sequence shown in FIG. 5, a negative scattering prevention voltage is continuously applied to the electrode 57 but may also be applied intermittently as shown in FIG. 6. The scattering prevention voltage may be applied at least during the passage of the toner images carried on the intermediary transfer belt 5 through the separation portion of the secondary transfer portion T2. Accordingly, the scattering prevention voltage is applied to the electrode 57 during a period from after a lapse of a movement time T1 of the toner image from the primary transfer portion T1 to the secondary transfer portion T2 to a time T3 at which the rear end of the image passes through the secondary transfer portion T2.

Further, when the toner image is located in an area ranging from the secondary transfer portion T2 to the primary transfer portion T1, the released toner scatters toward the conveyance portion 82. For this reason, a period in which a negative bias voltage is applied to the electrode 57 is provided during a period from the passage through the secondary transfer portion T2 of a forward end al of the image area on the intermediary transfer belt 5 in the rotational direction of the intermediary transfer belt 5 to the reaching to the primary transfer portion T2 of a rear end a2 of the image area.

The bias voltage as the scattering prevention voltage is set by the control portion 400 depending on an output of a temperature and humidity sensor 66 disposed inside the image forming apparatus since an amount of electric charge of the toner varies depending on a temperature and humidity environment. By changing a set value of the bias voltage depending on the temperature and humidity environment, scattering prevention is more effectively achieved.

For example, in a low-humidity environment, the toner charge amount is liable to increase. In this case, when the toner is superposed on the previously transferred toner, the upper toner on which a repulsive force from the lower toner is exerted is liable to scatter. For this reason, the scattering prevention voltage is correspondingly increased. More specifically, the scattering prevention voltage ("SPV") is set as shown in Table 1.

However, in the low-humidity environment, when a large electric discharging voltage is applied, excessive ions are generated to lower an electric resistance of the intermediary transfer belt 5 or the backup roller 59 or the like, thus causing an irregularity in electric discharge in some cases. For this reason, an electric discharging voltage (a voltage during secondary transfer ("VDST") shown in Table 1) applied to the electrode 57 during the secondary transfer of the toner images onto the recording material 71 is set to be lower than the scattering prevention voltage.

In the control depending on the environment, the control portion 400 detects an output of the temperature and humidity sensor 66 provided inside the image forming apparatus and performs an arithmetic computation to obtain a water (moisture) content (absolute water content ("AWC")) contained in 1 kg of air. Depending on the thus obtained water content, a bias voltage to be applied to the electrode 57 is determined. The applied bias voltage, strictly, various depending on the position, a constitution, and the like of the electrode 57 but may be set in a range from about −1000 V to about −5000 V, preferably in a range from about −2000 V to about −4000 V.

TABLE 1

| AWC (g/kg) | ≦5.8 | 5.8< and ≦10.5 | 10.5< and ≦15 | 15< |
|---|---|---|---|---|
| SPV (volts) | −3500 | −3000 | −2500 | −2000 |
| VDST (volts) | −3000 | −2000 | −500 | −500 |

The constitute of this embodiment is suitably used in an image forming apparatus in which the toner image carrying intermediary transfer belt 5 passes through the portion close to the secondary transfer portion T2, particularly an image forming apparatus in which the attraction fan 61 for attracting an ambience is provided to the conveyance portion 82 downstream from the secondary transfer portion transfer. By providing the electrode 57 as a position downstream from the secondary transfer portion T2 and upstream from the conveyance portion 82, it is possible to suppress the contamination of the conveyance portion 82 after the secondary transfer is performed, so that the contamination of the recording material 71 can be prevented. To the electrode 57 provided at the position in noncontact with the recording material 71, the bias voltage of an identical polarity to the charge polarity of the toner images carried on the intermediary transfer belt 5 is applied at least when the toner image carrying intermediary transfer belt 5 passes through the secondary transfer portion T2. As a result, it is possible to suppress the contamination of the conveyance portion 82 on which the recording material 71 is conveyed in contact with the conveyance portion 82.

Second Embodiment

Figure 7:
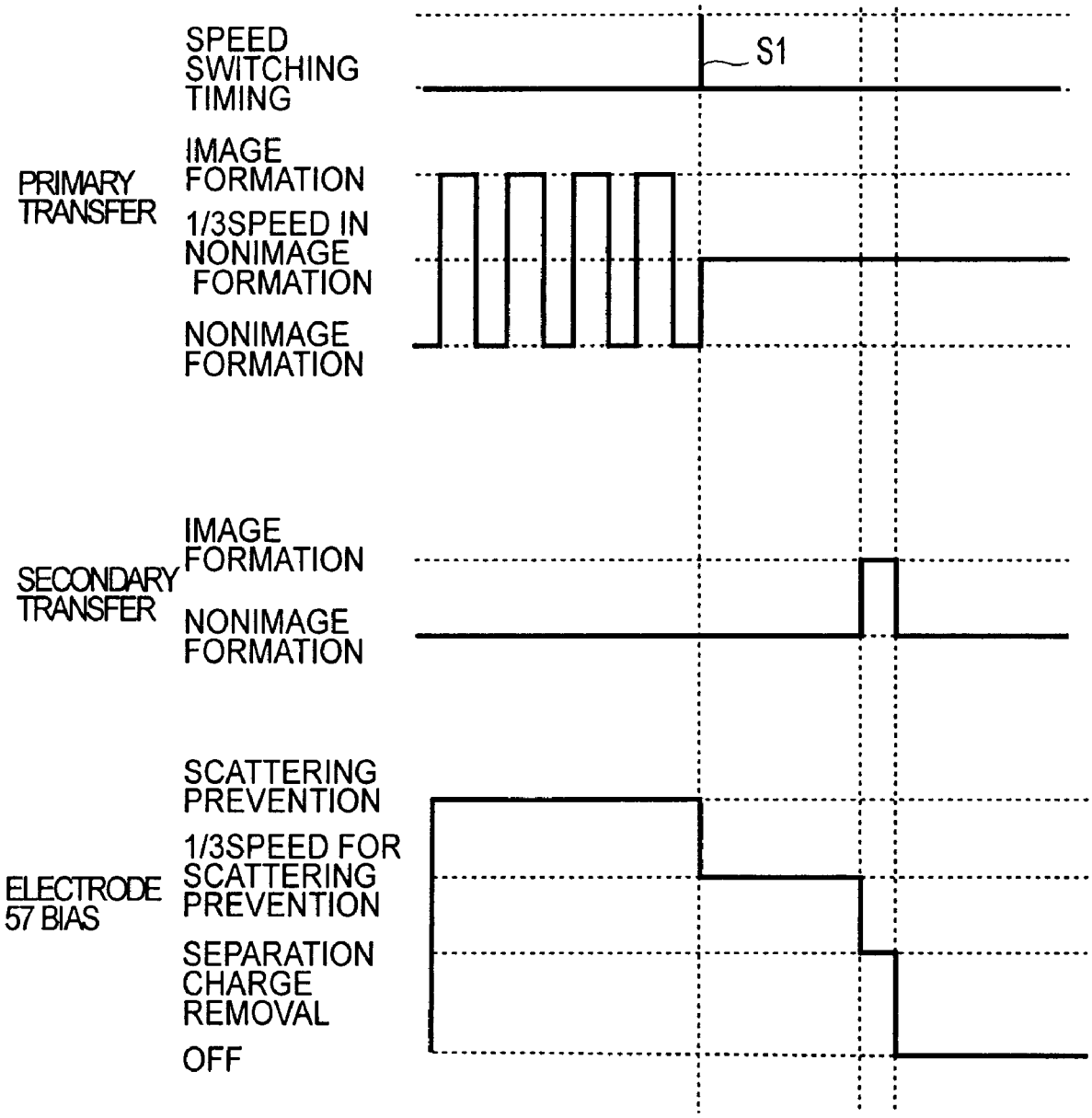
FIG. 7 is a time chart showing a control sequence in Second Embodiment.

FIG. 7 is a time chart showing a sequence of control in Second Embodiment. An image forming apparatus of Second Embodiment has the same constitution as the image forming apparatus 100 of First Embodiment except that control of the bias voltage applied to the electrode 57 is different from that in First Embodiment. Accordingly, explanation for the constitution of the image forming apparatus will be omitted.

The control in Second Embodiment is characterized by providing a step in which a fixing speed is switched since a fixing performance varies depending on the kind of the recording material 71. The control portion 400 changes also a movement speed of the intermediary transfer belt 5 depending on the switching of the fixing speed.

In this embodiment, the case where the process speed is decreased to a value, lower than an ordinary process speed, depending on a basis weight or surface properties of the recording material 71 will be described. First, up to the step in which the four color toner images are multiple-transferred from the photosensitive drum 1 onto the intermediary transfer belt 5, the image forming process is identical to that in First Embodiment.

Next, rotation control for lowering a circulation speed of the intermediary transfer belt 5 to a fixing speed depending on the kind of medium as the recording material 71 is effected. In this case, the intermediary transfer belt 5 placed in a state in which the four color toner images are superposed and formed on the intermediary transfer belt 5 is further rotated one full turn at a slower speed (than the ordinary process speed). As a result, the intermediary transfer belt 5 slowly passed through the secondary transfer portion T2 and the portion close to the conveyance portion 82, so that a degree of contamination due to the released and scattered toner is liable to be increased.

In Second Embodiment, the above described low speed mode (⅓ of the ordinary process speed) is employed in the case of a basis weight of more than 105 g/m$^2$ and in the case of image formation on coated paper. Thus, in Second Embodiment, the process speeds at two levels are described but it is also possible to set levels of the bias voltage to be applied to the electrode 57 depending on the number of levels of the process speed when the process speed has three or more levels.

Referring to FIG. 7, the step of forming the four color toner images on the intermediary transfer belt 5 is identical to that in First Embodiment. In this embodiment, thereafter, the bias voltage to be applied to the electrode 57 is switched from the scattering prevention voltage ("SPV") to a voltage at ⅓ process speed ("⅓—speed BV") in synchronism with a timing a speed switching signal S1 for providing a predetermined fixing speed. The voltage at ⅓ process speed is higher in absolute value than the scattering prevention voltage as shown in Table 2, thus enhancing the scattering prevention effect of toner from the intermediary transfer belt 5. The voltage at ⅓ process speed is continuously applied until the image forming process goes to the secondary transfer step in which the voltage during secondary transfer ("VDST") is applied. At the same time when the secondary transfer step starts, the bias voltage applied to the electrode 57 is changed to the electric discharging voltage for separation during secondary transfer ("VDST").

Specific setting values of the bias voltages in Second Embodiment are adjusted depending on the environmental condition similarly as in First Embodiment and are shown in Table 2.

TABLE 2

| AWC (g/kg) | ≦5.8 | 5.8< and ≦10.5 | 10.5< and ≦15 | 15< |
|---|---|---|---|---|
| SPV (volts) | −3500 | −3000 | −2500 | −2000 |
| ⅓-speed BV (volts) | −4000 | −3250 | −2500 | −2000 |
| VDST (volts) | −3000 | −2000 | −500 | −500 |

As described above, also in the case of the image forming apparatus in which the circulation speed of the intermediary transfer belt 5 is switched, by providing the electrode 57 at the position downstream from the secondary transfer portion T2 and upstream from the conveyance portion 82, it is possible to suppress the contamination of the conveyance portion 82 after the secondary transfer is performed. As a result, the contamination of the recording material 71 can be prevented.

Third Embodiment

Figure 8:
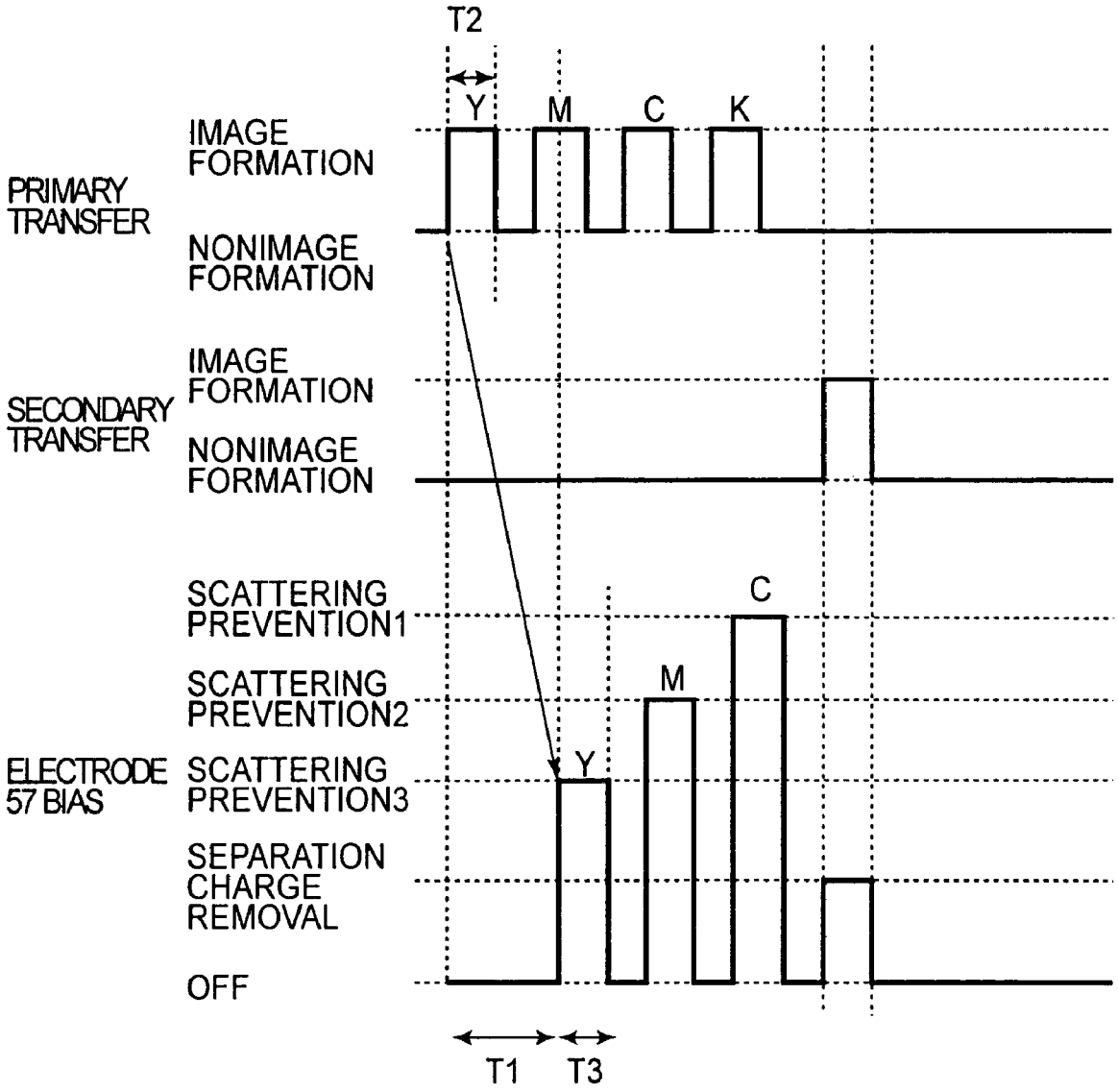
FIG. 8 is a time chart showing a control sequence in Third Embodiment.
Figure 9:
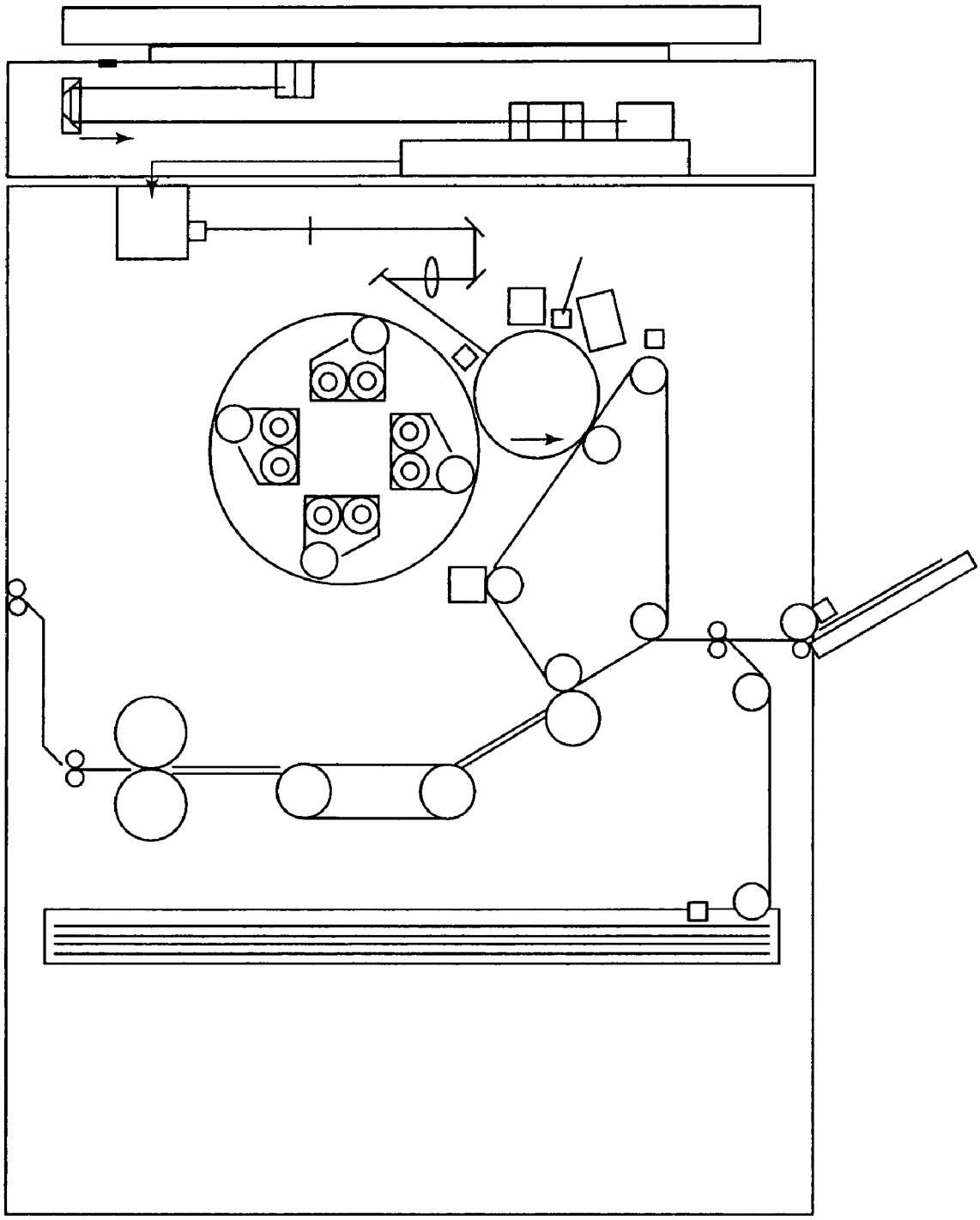
FIG. 9 is a schematic view of a conventional image forming apparatus.

FIG. 8 is a time chart showing a sequence of control in Third Embodiment. An image forming apparatus of Third Embodiment has the same constitution as the image forming apparatus 100 of First Embodiment except that control of the bias voltage applied to the electrode 57 is different from that in First Embodiment. Accordingly, explanation for the constitution of the image forming apparatus will be omitted.

The control in Second Embodiment is characterized by increasing the scattering prevention voltage ("SPV") with an increasing number of multiple transfer from the photosensitive drum 1 onto the intermediary transfer belt 5 at the primary transfer portion T1 shown in FIG. 1.

When toner images having the same electric charge polarity are superposed, the toner is liable to be separated and scattered from the intermediary transfer belt 5.

In view of this point, as shown in FIG. 8, a scattering prevention voltage (output) 2 at the time when toner images superposed two times pass through the secondary transfer portion T2 is higher than a scattering prevention voltage (output) 3 at the time when a (first) toner image superposed one time (on the intermediary transfer belt 5) passes through the secondary transfer portion T2. Further, a scattering prevention voltage (output) 1 at the time when toner images superposed three times pass through the secondary transfer portion T2 is higher than the scattering prevention voltage (output) 2 for the two times of superposition. In this manner, by increasing the bias voltage with an increasing number of superposition of the toner images, it is possible to efficiently suppress the toner contamination of the conveyance guide 63 and the conveyance portion 82 and image failure resulting from the toner contamination. Respective setting values of the bias voltages in Third Embodiment are shown in Table 3.

The control in Third Embodiment may also be performed in combination with that in Second Embodiment in which the scattering prevention voltage is switched together with the switching of the circulation speed of the intermediary transfer belt 5. A scattering prevention voltage (output) at the time when toner images superposed four times pass through the secondary transfer portion T2 may desirably be higher than the scattering prevention voltage (output) 1 for the three times of superposition.

TABLE 3

| AWC (g/kg) | ≦5.8 | 5.8< and ≦10.5 | 10.5< and ≦15 | 15< |
|---|---|---|---|---|
| SPV 1 (volts) | −3500 | −3000 | −2500 | −2000 |
| SPV 2 (volts) | −3000 | −2500 | −2000 | −1500 |
| SPV 3 (volts) | −2500 | −2000 | −1500 | −1000 |
| VDST (volts) | −3000 | −2000 | −500 | −500 |

In the present invention, the image forming apparatus 100 includes the photosensitive drum 1 for carrying a toner image having an electric charge, the primary transfer 51 for primary-transferring the toner image from the photosensitive drum 1 onto the intermediary transfer belt 5 at the primary transfer portion T1, the secondary transfer roller 52 for secondary-transferring the toner image from the intermediary transfer belt 5 onto the moving recording material 71 at the secondary transfer portion T2, the hot roller-type fixing device 9 for fixing the toner image on the recording material 71, the conveyance portion 82 for guiding the recording material 71 from the secondary transfer portion T2 toward the hot roller-type fixing device 9, the electrode 57 located between the secondary transfer portion T2 and the conveyance portion 82 in the movement direction of the recording material 71, and the DC electric power source 64 for applying a voltage to the electrode 57. The first toner image carried on the intermediary transfer belt 5 passes through the secondary transfer portion T2 and is moved again to the primary transfer portion T1. At the primary transfer portion T1, the second toner image carried on the photosensitive drum 1 is primary-transferred onto the intermediary transfer belt 5 so that the second toner image is superposed on the first toner image. In the present invention, a period in which a voltage of an identical polarity to the charge polarity of the toner is applied from the DC electric power source 64 to the electrode 57 is provided during a period from a time at which the toner images carried on the intermediary transfer belt 5 pass through the secondary transfer portion T2 to a time at which the toner images then pass through the primary transfer portion T1.

In the image forming apparatus 100, by applying the bias voltage of the same polarity as the charge polarity of the toner images to the electrode 57, an electric field in such a direction that the toner images are pressed against the surface of the intermediary transfer belt 5 is formed between the surface of the electrode 57 and the surface of the intermediary transfer belt 5. As a result, compared with the case of no application of the bias voltage, the toner is less liable to be separated and scattered from the surface of the intermediary transfer belt 5.

Here, a part of the toner of the toner images is electrically charged to an opposite polarity, so that there is a possibility that the toner is attracted to the electrode 57. However, the electrode 57 is disposed in non-contact with the recording material 71 conveyed from the secondary transfer portion T2 to the conveyance portion 82, so that the reverse-polarity toner collected by the electrode 57 does not contact the recording material 71 and thus is not deposited on the recording material 71.

The electrode 57 in the image forming apparatus 100 electrically discharges the recording material 71 on which the toner images are secondary-transferred.

The image forming apparatus 100 includes the toner-collecting portion 58, for collecting and accumulating the scattered toner from the intermediary transfer belt 5, provided between the electrode 57 and the secondary transfer roller 52 in the movement direction of the recording material 71.

The image forming apparatus of Second Embodiment controls the above described voltage applied from the DC electric power source 64 to the electrode 57, depending on the movement speed of the intermediary transfer belt 5, during a period from the time at which the toner images carried on the intermediary transfer belt 5 pass through the secondary transfer portion T2 to the time at which the toner images pass through the primary transfer portion T1.

The image forming apparatus of Third Embodiment controls the above described voltage applied from the DC electric power source 64 to the electrode 57, depending on the number of the toner images superposed on the intermediary transfer belt 5, during the period from the time at which the toner images carried on the intermediary transfer belt 5 pass through the secondary transfer portion T2 to the time at which the toner images pass through the primary transfer portion T1.

The image forming apparatus 100 includes the temperature and humidity sensor 66 for detecting at least one of the temperature and the humidity and includes the control portion 400 for controlling the above described voltage applied to the electrode 57, depending on a detection result of the temperature and humidity sensor 66, during the period from the time at which the toner images carried on the intermediary transfer belt 5 pass through the secondary transfer portion T2 to the time at which the toner images pass through the primary transfer portion T1.

The guide means of the image forming apparatus 100 includes the conveyance portion 82 for conveying the recording material 71 on which the toner images are secondary-transferred and the attraction fan 61 for attracting the recording material 71 to the conveyance portion 82 by forming a negative pressure at the lower surface of the recording material 71. Accordingly, without requiring an additional large-size part and damaging the toner images, it is possible to obviate the contamination of the moving recording material 71 by preventing the contamination of the conveyance portion 82, provided with the attraction fan 61, with the scattered toner.

The image forming apparatus 100 includes the exposure apparatus 3 for exposing the surface of the photosensitive drum 1 electrically charged uniformly to light to form an electrostatic image; the rotary-type developing device holding portion 4 for developing the electrostatic image with toner to form a toner image by selectively applying the plurality of developing devices 41, 42, 43 and 44 accommodating different colors of toners with respect to the photosensitive drum 1; and the primary transfer roller 51, disposed opposite to the photosensitive drum 1 via the intermediary transfer belt 5, for primary-transferring the toner images from the photosensitive drum 1 onto the intermediary transfer belt 5.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 106615/2006 filed Apr. 7, 2006, which is hereby incorporated by reference.

What is claimed is:

1. An image forming apparatus comprising:

an image carrying member for carrying a toner image;

an intermediary transfer member for primary-transferring the toner image at a primary transfer position so that a second color toner image is primary-transferred from said image carrying member onto a first color toner image which has been transferred, in an image area at a primary transfer position, from said image carrying member onto said intermediary transfer member in the image area at the primary transfer position in a superposition manner;

a secondary transfer member for secondary-transferring the first and second color toner images together from said intermediary transfer member onto a recording material at a secondary transfer position;

a fixing means for fixing the toner images on the recording material;

a guide member for guiding the recording material from the secondary transfer position to said fixing means;

an electrical discharging member, provided between the secondary transfer position and said guide member in a movement direction of the recording material, for electrically discharging the recording material onto which the toner images are secondary-transferred; and a voltage application means for applying, to said electrical discharging member before the secondary transfer, a voltage of a polarity identical to that of the first color toner image on said intermediary transfer member in a predetermined period during a period from a time at which a front end of the image area of said intermediary transfer member carrying the first color toner image passes through the secondary transfer position to a time at which a rear end of the image area reaches the first transfer position.

2. An apparatus according to claim 1, wherein said image forming apparatus further comprises a toner collecting portion, provided between said discharging member and the secondary transfer position in the movement direction of the recording material, for collecting a toner scattered from said intermediary transfer member.

3. An apparatus according to claim 2, wherein said image forming apparatus further comprises a control means for controlling a voltage applied from said voltage application means to said discharging member, depending on a moving speed of said intermediary transfer member, in a period from a time at which a front end of the toner image on said intermediary transfer member passes through the secondary transfer position to a time at which a rear end of the toner image reaches the primary transfer position.

4. An apparatus according to claim 2, wherein said image forming apparatus further comprises a control means for controlling a voltage applied from said voltage application means to said discharging member, depending on the number of toner images superposed on said intermediary transfer member, in a period from a time at which a front end of the toner image on said intermediary transfer member passes through the secondary transfer position to a time at which a rear end of the toner image reaches the primary transfer position.

5. An apparatus according to claim 2, wherein said image forming apparatus further comprises an environment detection means for detecting at least one of a temperature and a humidity and a control means for controlling a voltage applied from said voltage application means to said discharging member, depending on a detection result of said environment detection means, in a period from a time at which a front end of the toner image on said intermediary transfer member passes through the secondary transfer position to a time at which a rear end of the toner image reaches the primary transfer position.

* * * * *